US010008785B2

(12) United States Patent
Trombley

(10) Patent No.: US 10,008,785 B2
(45) Date of Patent: Jun. 26, 2018

(54) CLAMPING ASSEMBLY FOR ATTACHING A GROUNDING CONDUCTOR TO A PIPE HAVING A PROTECTIVE COATING

(71) Applicant: Hubbell Incorporated, Shelton, CT (US)

(72) Inventor: Logan M. Trombley, Manchester, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days. days.

(21) Appl. No.: 15/176,927

(22) Filed: Jun. 8, 2016

(65) Prior Publication Data

US 2017/0358872 A1 Dec. 14, 2017

(51) Int. Cl.

| | |
|---|---|
| ***H01R 4/66*** | (2006.01) |
| ***H01R 4/2408*** | (2018.01) |
| ***H01R 4/64*** | (2006.01) |
| ***H01R 4/60*** | (2006.01) |
| ***H01R 13/621*** | (2006.01) |
| ***H01R 13/655*** | (2006.01) |

(52) U.S. Cl.

CPC ..... *H01R 4/2408* (2013.01); *H01R 4/60* (2013.01); *H01R 4/643* (2013.01); *H01R 4/66* (2013.01); *H01R 13/6215* (2013.01); *H01R 13/655* (2013.01)

(58) Field of Classification Search

CPC ..... H01R 4/60; H01R 4/643; H01R 4/66
USPC ..... 439/100, 799, 800
See application file for complete search history.

(56) References Cited

U.S. PATENT DOCUMENTS

| | | | | |
|---|---|---|---|---|
| 4,664,469 | A * | 5/1987 | Sachs | H01R 4/60 439/100 |
| 4,875,864 | A * | 10/1989 | Campbell | H01R 4/643 439/100 |
| 6,089,881 | A | 7/2000 | Daoud | |
| 6,202,300 | B1 * | 3/2001 | Yuzwalk | H01R 4/643 29/857 |
| 8,092,129 | B2 | 1/2012 | Wiley | |
| 2005/0266707 | A1 * | 12/2005 | Franks, Jr. | H05K 5/02 439/92 |

(Continued)

OTHER PUBLICATIONS

International Search Report and Written Opinion mailed in International Application No. PCT/US17/36421 dated Jun. 22, 2017 (9 pages).

*Primary Examiner* — Abdullah Riyami
*Assistant Examiner* — Justin Kratt
(74) *Attorney, Agent, or Firm* — Wissing Miller LLP

(57) ABSTRACT

A clamping assembly for attaching a grounding conductor to a pipe having a protective coating includes an elongate conductive strap and a clamp. The conductive strap is sufficiently long to circumferentially surround the pipe and has longitudinally spaced sharp projections that are sufficient to penetrate the protective coating around the pipe to make an electrical coupling between the strap and a conductive part of the pipe beneath the protective coating. The clamp is coupled to the grounding conductor and clamps the conductive strap to the pipe at a tension sufficient to maintain an electrical connection between the conductive part of the pipe and the grounding conductor without the need for any welding of the grounding conductor to the pipe and without the need for any stripping of the protective coating from the pipe.

19 Claims, 9 Drawing Sheets

(56) References Cited

U.S. PATENT DOCUMENTS

2012/0110803 A1 5/2012 Hasegawa

* cited by examiner

CLAMPING ASSEMBLY FOR ATTACHING A GROUNDING CONDUCTOR TO A PIPE HAVING A PROTECTIVE COATING

TECHNICAL FIELD

The present invention relates to clamping devices, and in particular mechanical clamps for attaching a grounding conductor to a coated pipe.

BACKGROUND OF THE INVENTION

A series of interconnected large diameter pipes (i.e., pipes with at least 12 inches in diameter) are used to carry fluid such as oil from one location to another. To properly discharge the potential electricity buildup from lightening or static electricity buildup from the flowing fluid, the pipes are connected to a grounding conductor which is then connected to an underground grounding system through, for example, a grounding rod.

For protection from the elements and corrosion resistance, however, the pipes are typically coated with a protective or insulative coating such as powder coating or paint, which makes it difficult to make a solid electrical connection to the pipes.

Conventionally, a grounding connection is accomplished by stripping the protective coating from the pipes and then welding a grounding conductor to the pipes. However, stripping and welding are very time consuming processes and are very expensive as they require a licensed welder and a licensed inspector to inspect the weld.

Therefore, it would be desirable to provide a device and method for connecting the pipes to a grounding conductor which is easy to install in a cost efficient and time saving manner.

BRIEF SUMMARY OF THE DISCLOSURE

In one aspect of the present invention, a clamping assembly for attaching a grounding conductor to a pipe having a protective coating is provided with an elongate conductive strap and a clamp. The conductive strap is sufficiently long to circumferentially surround the pipe and has longitudinally spaced sharp projections that are sufficient to penetrate the protective coating around the pipe to make an electrical coupling between the strap and a conductive part of the pipe beneath the protective coating. The clamp is coupled to a grounding conductor and clamps the conductive strap to the pipe at a tension sufficient to maintain an electrical connection between the conductive part of the pipe and a grounding conductor.

Since the sharp projections in contact with the conductive part of the pipe maintains a solid electrical connection between the pipe and the grounding conductor, the present invention advantageously eliminates the need for any welding of the grounding conductor to the pipe and any stripping of the protective coating from the pipe. Consequently, the clamping assembly of the present invention allows attachment of a grounding conductor to a coated pipe in a cost efficient and time saving manner.

DETAILED DESCRIPTION OF THE INVENTION

Figure 1:
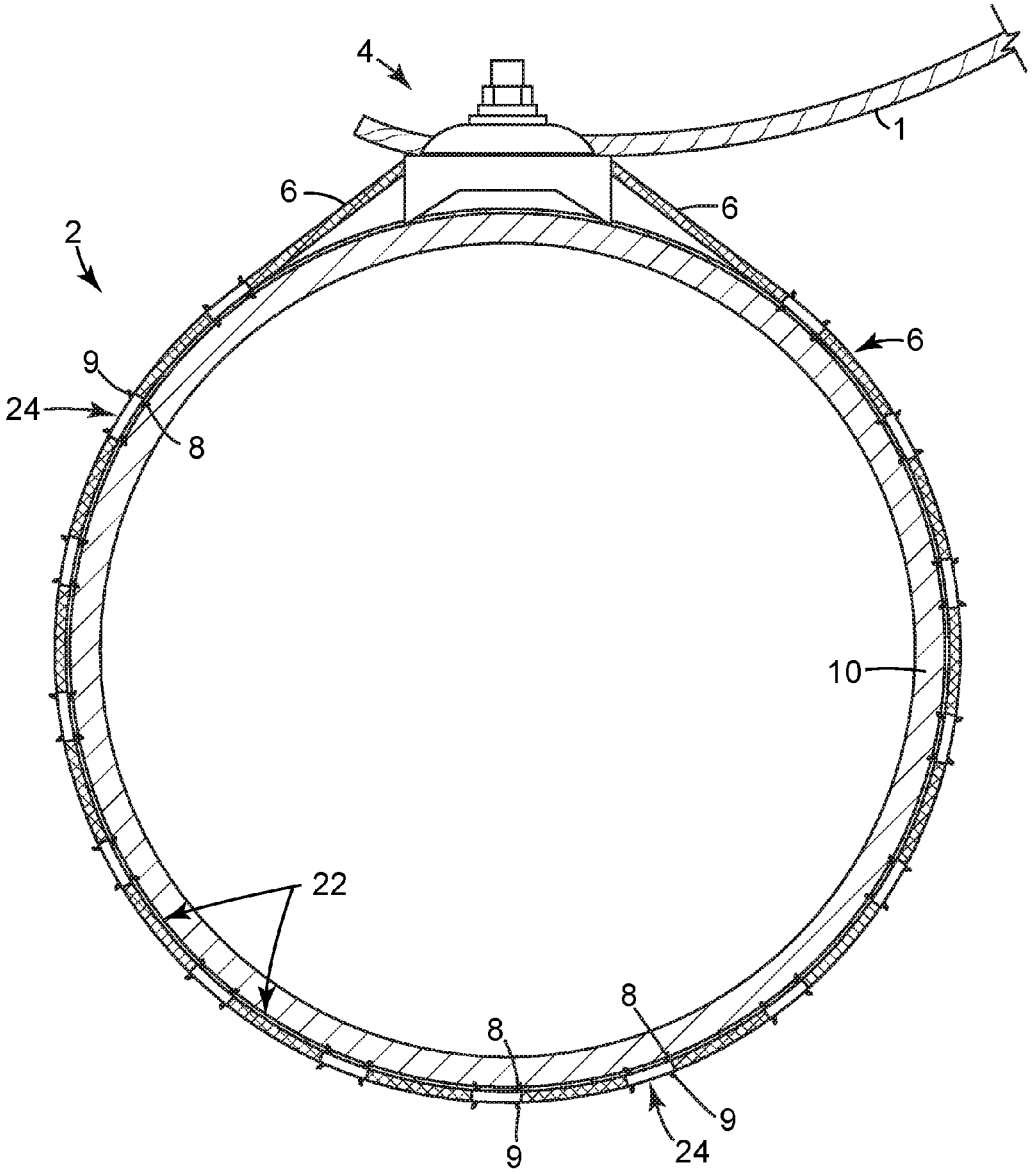
FIG. 1 illustrates a grounding clamp assembly according to an aspect of the present invention.

FIG. 1 illustrates a grounding clamp assembly 2 according to an aspect of the present invention. The grounding clamp assembly 2 includes a grounding clamp 4 and an elongate conductive clamping strap 6 having sharp projections 8 that are longitudinally spaced along the strap. When installed, the conductive clamping strap 6 surrounds a large diameter pipe 10 and its two ends are clamped by the grounding clamp 4. As an example construction, the conductive strap 6 is at least 37 inches long to accommodate the circumference of a 12 inch diameter pipe. A grounding conductor 1 has one end which is coupled to a grounding system (not shown) and an opposite end which is electrically coupled to the clamp 4.

Figure 4:
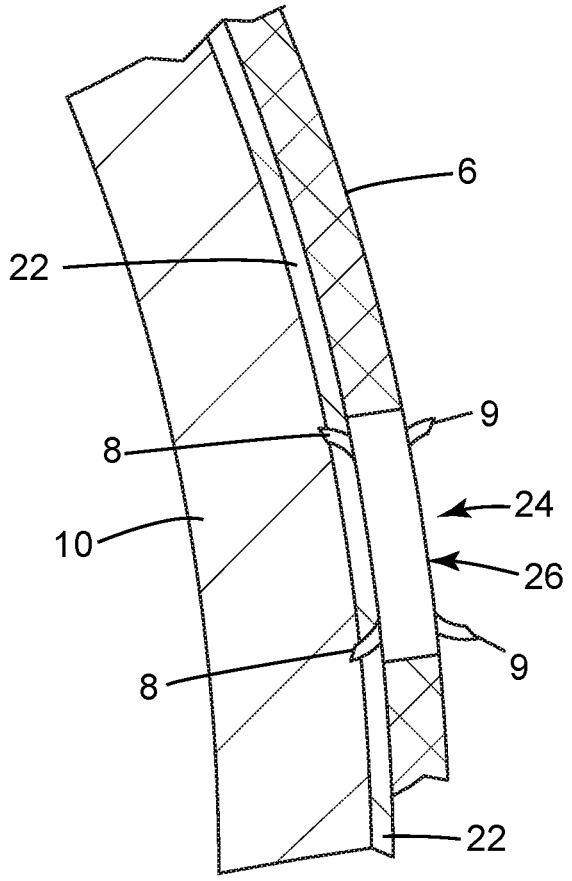
FIG. 4 illustrates sharp projections on a large diameter pipe according to an aspect of the present invention.

As shown in FIGS. 1 and 4, the pipe 10 has a corrosion resistant coating 22 on its outside to protect the pipe from the elements. As an example, the coating 22 can be an electrically insulative coating. When the conductive strap 6 is under tension provided by the clamp 4, the projections 8 are sufficiently sharp to penetrate the protective coating 22 of the pipe 10 to make a solid electrical contact with a conductive part of the pipe underneath the coating. The projections 8 provide an electrical path from the pipe 10 to the grounding conductor 1.

The conductive strap 6 can include any electrically conductive material. In one embodiment, the strap 6 can be an electrically conductive braid made of woven copper wire. In another embodiment, the strap 6 can be a metallic sheet.

The sharp projections 8 can be formed on the conductive strap 6. In one embodiment, the sharp projections 8 can be formed on an annular one-piece eyelet 24 as shown in detail in FIG. 5A. In one embodiment, the eyelets 24 are uniformly spaced longitudinally on the clamping strap 6. For example, for a 24 inch diameter pipe, the eyelets 24 can be longitudinally and uniformly spaced every two inches along the strap 6. The eyelets 24 can be made of steel or other durable and strong material that has a good electrical conductivity. Other eyelets that can be used in the present invention are described in U.S. Patent App. Pub. No. 2012/0110803, which is incorporated herein by reference.

As shown in FIG. 4, each eyelet 24 is mounted to the strap 6 through a corresponding mounting hole 26 on the strap by swaging the stud 30 after the stud has passed through the mounting hole. The sharp projections 8 are circumferentially formed in the flange 32 with a predetermined space between adjacent projections. Each of the projections 8 can be cut and previously raised from the flange 32 or cut in place and subsequently raised from the flange 32. Alternatively, the eyelet 24 can be formed with the sharp projections 8 in a mold such as a metal injection mold. Each projection 8 generally tapers to a sharp point and extends laterally away from the flange 32 of the eyelet 24.

As shown in FIG. 4, when the clamping strap 6 has been clamped around the pipe 10 under tension, the projections 8 are sufficiently sharp to pierce the corrosion resistant coating 22 to make a solid electrical contact with the conductive portion of the pipe below the coating.

Figure 5A:
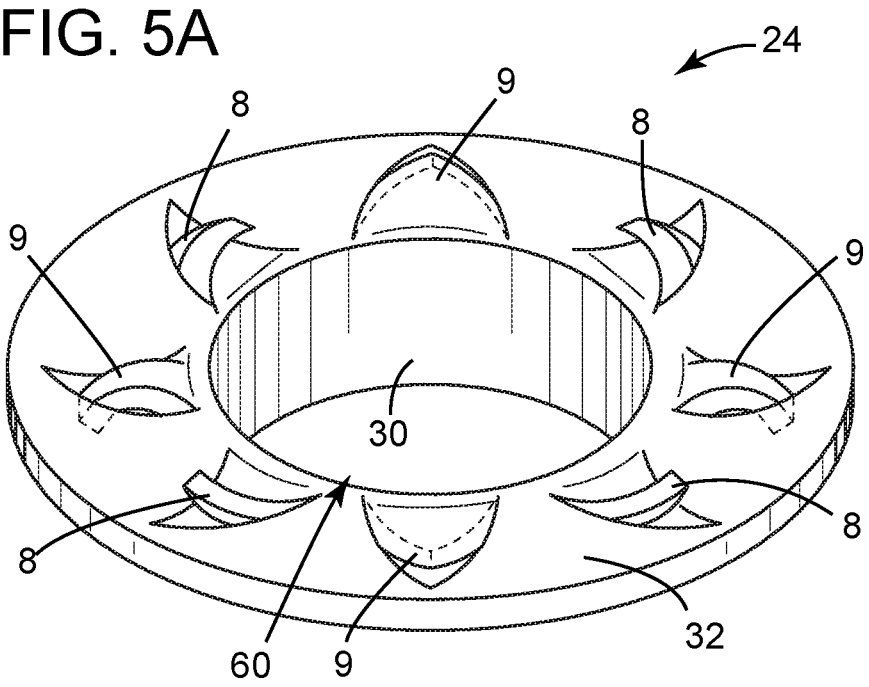
FIG. 5A is a perspective view of one embodiment of the sharp projections according to an aspect of the present invention.

In the embodiment shown in FIG. 5A, four sharp projections 8 are positioned on one side of the eyelet 24 and are equally spaced from each other so as to have a 90 degree angle of separation between two adjacent projections relative to a central axis of the eyelet 24. Sharp projections 9 are positioned on the other side of the eyelet 24 and are also equally spaced from each other so as to have a 90 degree angle of separation between two adjacent projections relative to a central axis of the eyelet 24. As can be seen in FIG. 5A, the projections 8 and 9 are interleaved with each other such that there is a 45 degree angle of separation between projection 8 and adjacent projection 9. The eyelet 24 of FIG. 5A is convenient since an installer can use either side of the clamping strap 6 against the surface of the pipe 10 without being concerned with which side of the conductive strap 6 is to face the pipe 10.

Figure 5B:
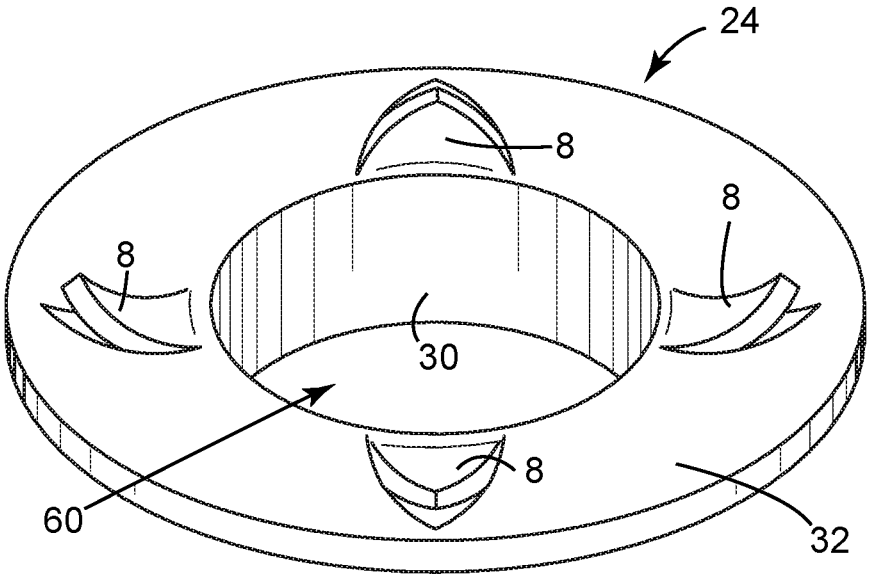
FIG. 5B is a perspective view of an alternative embodiment of the sharp projections according to an aspect of the present invention.

FIG. 5B is a perspective view of an alternative embodiment of the sharp projections 8 of an eyelet 24 as shown in FIG. 5A. The four sharp projections 8 are positioned on one side of the eyelet 24 and are equally spaced from each other so as to have a 90 degree angle of separation between two adjacent projections relative to a central axis of the eyelet 24. The eyelet 24 of FIG. 5B is similar to that of FIG. 5A, except that the sharp projections 8 are only on one side. The eyelets 24 of FIG. 5B can be advantageous for an area where there may be a higher risk of injury for installers or maintenance workers from the sharp projections 9.

Figure 6A:
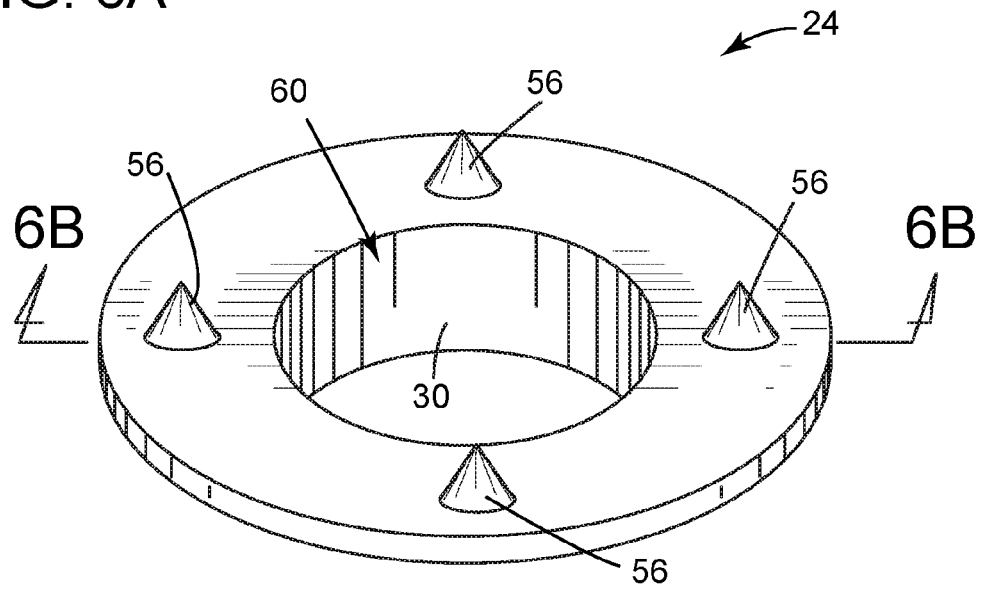
FIG. 6A is a perspective view of another embodiment of the sharp projections according to an aspect of the present invention.
Figure 6B:
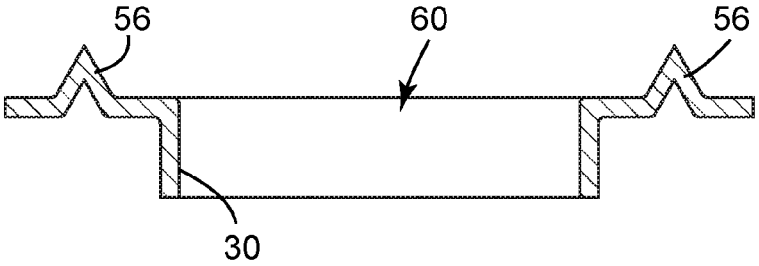
FIG. 6B is a cross-sectional view of FIG. 6A taken along lines 6B-6B.

FIG. 6A is a perspective view of another embodiment of the sharp projections according to an aspect of the present invention. FIG. 6B is a cross-sectional view of FIG. 6A taken along lines 6B-6B. Four sharp projections 56 are equally spaced from each other so as to have a 90 degree angle of separation between two adjacent projections relative to a central axis of the eyelet 24. The eyelet 56 of FIG. 6A is similar to that of FIG. 5B, except that the sharp projections 56 are formed with a mold without cutting so as to form a structurally more rigid projections than the projections 8 of FIG. 5A. This embodiment can be advantageous when the corrosion resistant coating 22 is relatively thick and more tension of the strap 6 is required to pierce the coating.

Figure 7A:
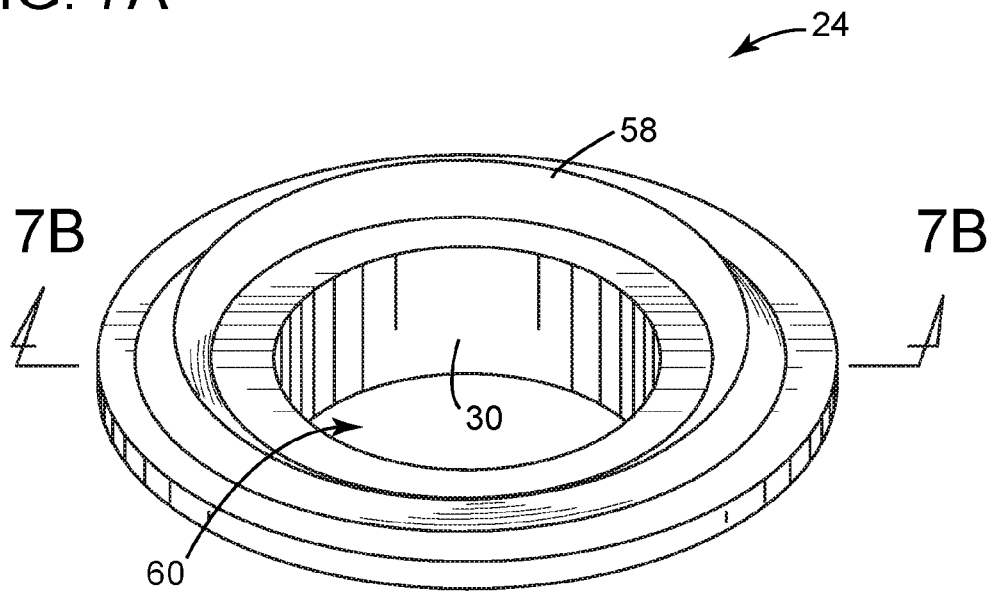
FIG. 7A is a perspective view of another embodiment of the sharp projections according to an aspect of the present invention.
Figure 7B:
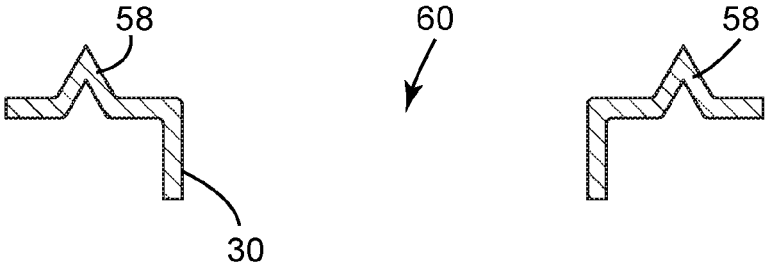
FIG. 7B is a cross-sectional view of FIG. 7A taken along lines 7B-7B.

FIG. 7A is a perspective view of another embodiment of the sharp projections according to an aspect of the present invention while FIG. 7B is a cross-sectional view of FIG. 7A taken along lines 7B-7B. In this embodiment, the projection 58 is similar to the projection 56 of FIG. 6A in that it is formed from a mold to increase the structural rigidity. However, the projection 58 of FIG. 7A is an annular ring and is arranged circumferentially around the flange 32. The projection 58 has a circumferentially continuous sharp edge that projects away from the flange 32.

While the flanges 32 and/or the holes 60 of the eyelets 24 in the embodiments shown have a round shape, other shapes such as square, rectangle and triangle for either the flanges or holes are also possible.

Figure 2:
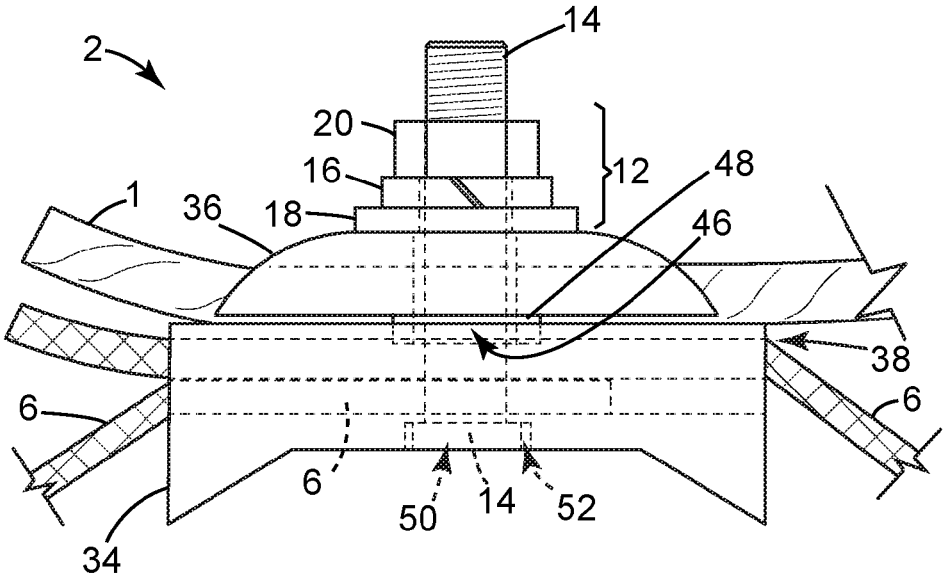
FIG. 2 illustrates a side view of a clamp of FIG. 1.
Figure 3A:
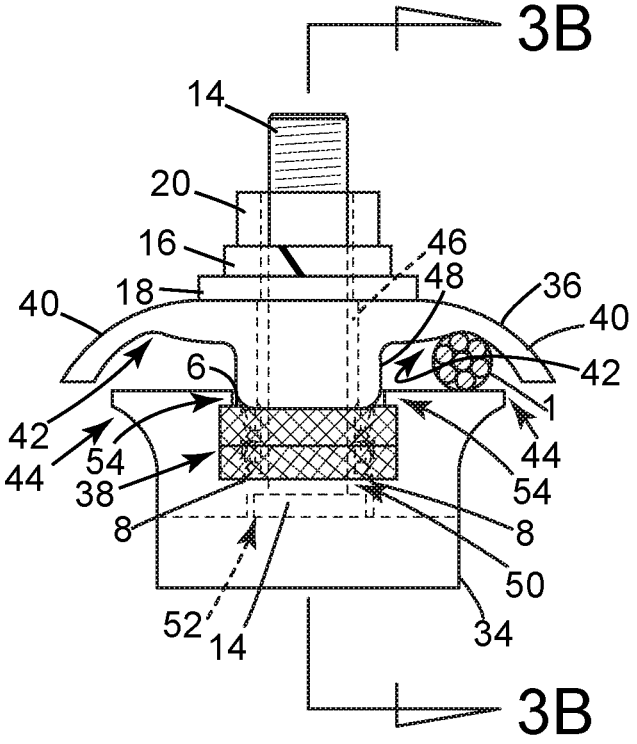
FIG. 3A illustrates a front view of the clamp of FIG. 1.
Figure 3B:
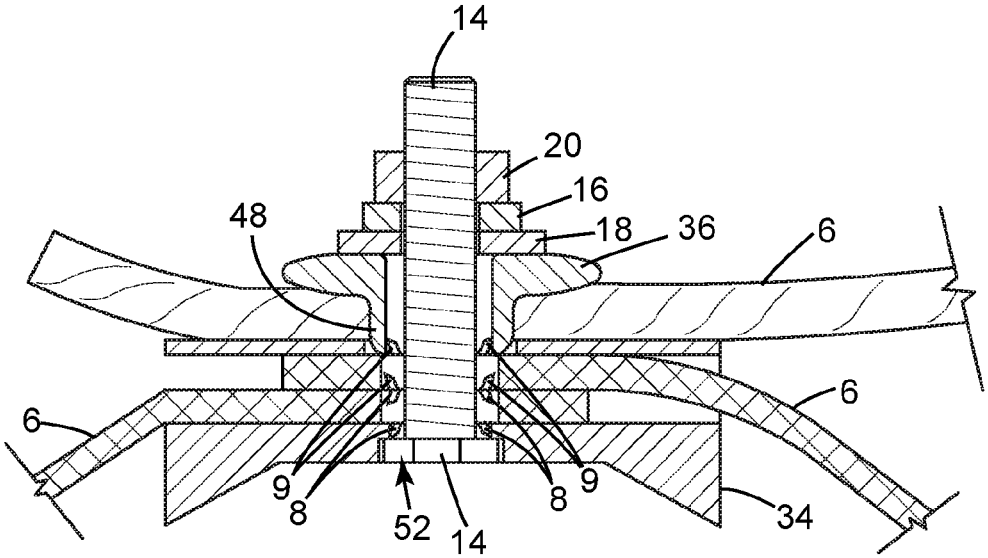
FIG. 3B illustrates a cross-sectional side view of FIG. 3A taken along lines 3B-3B.

FIG. 2 is a side view illustrating a clamp of FIG. 1 while FIG. 3A is a front view of the clamp. FIG. 3B illustrates a cross-sectional side view of FIG. 3A taken along lines 3B-3B. Referring to FIGS. 2 and 3A-3B, the clamp 4 includes a conductive clamping body 34 and a conductive cap 36. The bottom surface of the clamping body 34 is angled to match the outer surface of the pipe 10. While the bottom surface is shown to have a pair of downwardly angled planar surfaces, it can be continuously curved to more closely match the shape of the pipe 10.

The clamping body 34 has a recessed channel 38 that receives the opposite ends of the clamping strap 6. Tabs 54 above the recessed channel 38 prevent the strap 6 from being lifted and dislodged out of the recessed channel during installation to help secure the strap 6. The conductive cap 36 clamps the clamping strap 6 to the clamping body 34 with a bolt 14 and a locking assembly 12.

The cap 36 has a pair of downwardly extending sides (wings) 40 with each having a conductor groove 42 on its lower surface to receive the grounding conductor 1. The clamping body 34 has a pair of overhang pads 44 over which the ground conductor 1 lies. When the conductive cap 36 is clamped to the clamping body 34, the overhang pad 44 and its corresponding conductor groove 42 clamp the grounding conductor 1 to the clamp 4.

At its center, the conductive cap 36 has a boss 48 and through-hole 46 that extends through the boss. The boss 48 applies pressure on the clamping strap 6 and to carry current from the strap to the grounding conductor 1 through the conductive cap.

The clamping body 34 also has a corresponding through-hole 50 at its center and a recess 52 for receiving the head of a threaded bolt 14. The shape of the recess 52 is designed to match that of the head of the bolt 14 to prevent the bolt from rotating on its axis. For example, if the bolt 14 has a hexagonal shape, then the recess 52 also has a hexagonal shape. As can be seen in FIGS. 2 and 3A-3B, the bolt 14 is designed to be inserted through the through-hole 50, holes 60 of the corresponding eyelets 24 which are typically located near the opposite ends of the strap 6, through-hole 46 of the conductive cap 36 and a lock assembly 12 which includes a flat washer 18, lock washer 16, and nut 20. The lock assembly 12 is torqued to a specified value depending on the application.

A method of grounding a coated pipe to a grounding conductor will now be described. With the bolt 14 inserted through the through-hole 50, the clamping body 34 is rested on the pipe 10. A hole 60 of an eyelet 24 at a first end of the strap 6 is inserted over the bolt 14. The strap 6 is then wrapped around the pipe 10 and pulled toward the clamping body 34 at a sufficient tension to cause the sharp projections 8 to pierce the corrosion resistant coating 22, thereby making a solid electrical contact between the projections and the pipe 10. While tension is maintained, a hole 60 of an eyelet 24 near a second end of the strap 6 is inserted over the bolt 14 over the first end of the strap such that both sides of the straps are stacked on top of each other as shown in FIGS. 3A-3B.

Once both sides of the strap 8 are inserted through the bolt 14, the conductive cap 36 is inserted through the bolt 14. The grounding conductor 1 is then placed over the overhang pad 44 and is received in the conductor groove 42. While the conductive cap 36 is being pushed downwardly, the lock assembly 12 is used to lock the conductive cap to the clamping body 34 to a preselected torque by tightening the nut 20. When the conductive cap 36 is locked to the clamping body 34, the boss 48 and the side 40 respectively press down on the strap 6 and the conductor 1 to make a solid electrical contact between the strap 6 and the grounding conductor.

Consequently, the grounding clamp assembly 2 of the present invention allows an installer to electrically attach the grounding conductor to the pipe in an efficient and easy manner without resorting to the expensive process of stripping the protective coating or welding the grounding conductor to the pipe. Advantageously, the strap 6 can be used to fit nearly any size of larger diameter pipes so long as the strap 6 is sufficiently long to wrap around the pipe.

The foregoing specific embodiments represent just some of the ways of practicing the present invention. Many other embodiments are possible within the spirit of the invention. Accordingly, the scope of the invention is not limited to the foregoing specification, but instead is given by the appended claims along with their full range of equivalents.

What is claimed is:

1. A clamping assembly for attaching a grounding conductor to a pipe having a protective coating comprising:

an elongate conductive strap sufficiently long to circumferentially surround the pipe and having a plurality of longitudinally spaced sharp projections sufficient to penetrate the protective coating around the pipe;

a clamp adapted to be coupled to the grounding conductor and clamp the conductive strap that surrounds the pipe at a tension sufficient to maintain an electrical connection between a conductive part of the pipe and the grounding conductor; and a plurality of eyelets mounted in respective holes on the conductive strap, each eyelet having at least one of the plurality of sharp projections formed thereon.

2. The clamping assembly of claim 1, wherein each eyelet has at least one sharp projection projecting away from one side of the conductive strap and at least one sharp projection projecting away from the other side of the conductive strap.

3. The clamping assembly of claim 1, wherein the sharp projections are molded projections.

4. The clamping assembly of claim 1, wherein the clamp includes a conductive clamping body having a channel for receiving the opposite ends of the conductive strap.

5. The clamping assembly of claim 4, further comprising a bolt, wherein the clamping body has a through-hole sized to receive the bolt.

6. The clamping assembly of claim 5, further comprising a plurality of eyelets mounted in respective holes on the conductive strap, each eyelet having a hole sized to receive the bolt.

7. The clamping assembly of claim 5, further comprising a conductive cap that clamps the conductive strap to the clamping body, the conductive cap having a through-hole sized to receive the bolt.

8. The clamping body of claim 7, further comprising a locking assembly sized to be inserted over and lock the bolt to the conductive cap.

9. The clamping body of claim 7, wherein the cap has at least one boss for pressing the conductive strap against the clamping body.

10. A clamping assembly for attaching a grounding conductor to a pipe having a protective coating comprising:

an elongate conductive strap sufficiently long to circumferentially surround the pipe and having a plurality of longitudinally spaced sharp projections sufficient to penetrate the protective coating around the pipe;

a clamp adapted to be coupled to the grounding conductor and clamp the conductive strap that surrounds the pipe at a tension sufficient to maintain an electrical connection between a conductive part of the pipe and the grounding conductor; and a plurality of eyelets on which the sharp projections are formed, the sharp projection for each eyelet being arranged annularly and having a circumferentially continuous edge projecting away from the conductive strap.

11. A clamping assembly for attaching a grounding conductor to a pipe having a protective coating comprising:

an elongate conductive strap sufficiently long to circumferentially surround the pipe and having a plurality of longitudinally spaced sharp projections sufficient to penetrate the protective coating around the pipe;

a clamp adapted to be coupled to the grounding conductor and clamp the conductive strap that surrounds the pipe at a tension sufficient to maintain an electrical connection between a conductive part of the pipe and the grounding conductor; and a plurality of eyelets on which the sharp projections are formed, each sharp projection being cut and having a sharp tip raised away from the conductive strap.

12. The clamping assembly of claim 11, wherein each eyelet has a plurality of circumferentially uniformly spaced sharp projections.

13. A clamping assembly for attaching a grounding conductor to a large diameter pipe having a protective coating comprising:

an elongate conductive strap sufficiently long to circumferentially surround the pipe and having a plurality of longitudinally spaced holes;

a plurality of eyelets mounted in respective holes on the conductive strap, each eyelet having at least one sharp projection formed thereon, the sharp projection being sufficiently sharp to penetrate the protective coating around the pipe;

a clamp adapted to be coupled to the grounding conductor and clamp the conductive strap that surrounds the pipe at a tension sufficient to maintain an electrical connection between a conductive part of the pipe and the grounding conductor.

14. The clamping assembly of claim 13, wherein the sharp projection for each eyelet is arranged annularly and has a circumferentially continuous edge projecting away from the conductive strap.

15. The clamping assembly of claim 13, wherein each sharp projection is cut and has a sharp tip raised away from the conductive strap.

16. The clamping assembly of claim 13, wherein the sharp projections are molded projections.

17. The clamping assembly of claim 13, further comprising a bolt, wherein:

the clamp includes a conductive clamping body having a channel for receiving the opposite ends of the conductive strap and a through-hole sized to receive the bolt; and each eyelet has a hole sized to receive the bolt.

18. The clamping body of claim 17, further comprising a conductive cap that clamps the conductive strap to the clamping body, the conductive cap having a through-hole sized to receive the bolt.

19. A method of attaching a grounding conductor to a pipe having a protective coating comprising:

surrounding the pipe with an elongate conductive strap having a plurality of longitudinally spaced sharp projections and a plurality of eyelets mounted in respective holes on the conductive strap, each eyelet having at least one of the plurality of sharp projections formed thereon;

applying tension on the conductive strap in an amount sufficient for the sharp projections to penetrate the protective coating around the pipe so as to electrically couple the conductive strap to a conductive part of the pipe;

electrically coupling the grounding conductor to the conductive strap; and clamping the conductive strap to the pipe so as to electrically couple the conductive part of the pipe to the grounding conductor.

* * * * *